United States Patent [19]

Stewart et al.

[11] Patent Number: 4,545,894

[45] Date of Patent: Oct. 8, 1985

[54] CONTROL OF AN AROMATIC EXTRACTION

[75] Inventors: William S. Stewart; John E. Blaesi, both of Bartlesville, Okla.

[73] Assignee: Phillips Petroleum Company, Bartlesville, Okla.

[21] Appl. No.: 633,768

[22] Filed: Jul. 23, 1984

[51] Int. Cl.[4] ..... C10G 21/30

[52] U.S. Cl. ..... 208/311; 208/321; 203/3; 196/132

[58] Field of Search ..... 208/311, 321, 322, DIG. 1; 422/111; 196/132; 203/3

[56] References Cited

U.S. PATENT DOCUMENTS

| | | | |
|---|---|---|---|
| 3,111,460 | 11/1963 | Orr | 196/132 X |
| 3,156,628 | 11/1964 | Larrison | 203/3 |
| 3,445,381 | 5/1969 | De Graff et al. | 208/313 |
| 3,546,107 | 12/1970 | Brown et al. | 208/311 |
| 3,763,037 | 10/1973 | Thompson | 208/321 |
| 3,789,077 | 1/1974 | Kosseim et al. | 208/321 |
| 3,967,937 | 7/1976 | Hobbs | 196/32 X |
| 4,224,674 | 9/1980 | Sequeira, Jr. et al. | 208/311 X |
| 4,412,915 | 11/1983 | Kettinger | 208/311 |

*Primary Examiner*—D. E. Gantz
*Assistant Examiner*—Glenn A. Caldarola

[57] ABSTRACT

In an aromatic extraction process, the flow rate of aromatics to the extraction column is utilized to control the downstream stripping column so as to maintain a desired purity of the aromatic extract stream withdrawn from the stripping column. Also, the flow rate of solvent to the extraction column is manipulated so as to maintain a desired aromatic concentration in the raffinate stream withdrawn from the extraction column. This control, together with other interactive control functions, results in a control of the aromatic extraction process which substantially maximizes the profitability of the extraction process.

20 Claims, 2 Drawing Figures

CONTROL OF AN AROMATIC EXTRACTION

This invention relates to control of an aromatic extraction process. In one aspect, this invention relates to control of the purity of the aromatic extract withdrawn from an aromatic extraction process. In another aspect this invention relates to control of the aromatic concentration in the non-aromatic, raffinate stream withdrawn from the aromatic extraction process.

Aromatic extraction processes are well known. Essentially, an aromatic extraction process is utilized to separate aromatic hydrocarbons from non-aromatic hydrocarbons. As with any extraction process, it is desirable to maintain some specified purity for the extract stream (aromatic extract). However, such control can become complicated in a complex extraction process since upstream process changes may affect the purity of the downstream aromatic extract stream. It is thus an object of this invention to provide method and apparatus for controlling the purity of the aromatic extract stream in such a manner that upstream changes are compensated for in a feed forward manner.

It is also desirable in an aromatic extraction process to control the concentration of aromatics in the non-aromatic, raffinate stream to avoid the loss of aromatics. It is thus a further object of this invention to provide method and apparatus for controlling the concentration of aromatics in the raffinate stream so as to avoid losses of aromatics to the extent possible.

In accordance with the present invention, method and apparatus is provided whereby the flow rate of aromatics to the extraction column is utilized to control the downstream stripping column so as to maintain a desired purity of the aromatic extract stream withdrawn from the stripping column. Also in accordance with the present invention, the flow rate of solvent to the extraction column is manipulated so as to maintain a desired aromatic concentration in the raffinate stream withdrawn from the extraction column. This control, together with other interactive control functions, results in a control of the aromatic extraction process which substantially maximizes the profitability of the extraction process.

Other objects and advantages of the invention will be apparent from the foregoing brief description of the invention and the claims as well as the detailed description of the drawings which are briefly described as follows:

Figure 1:
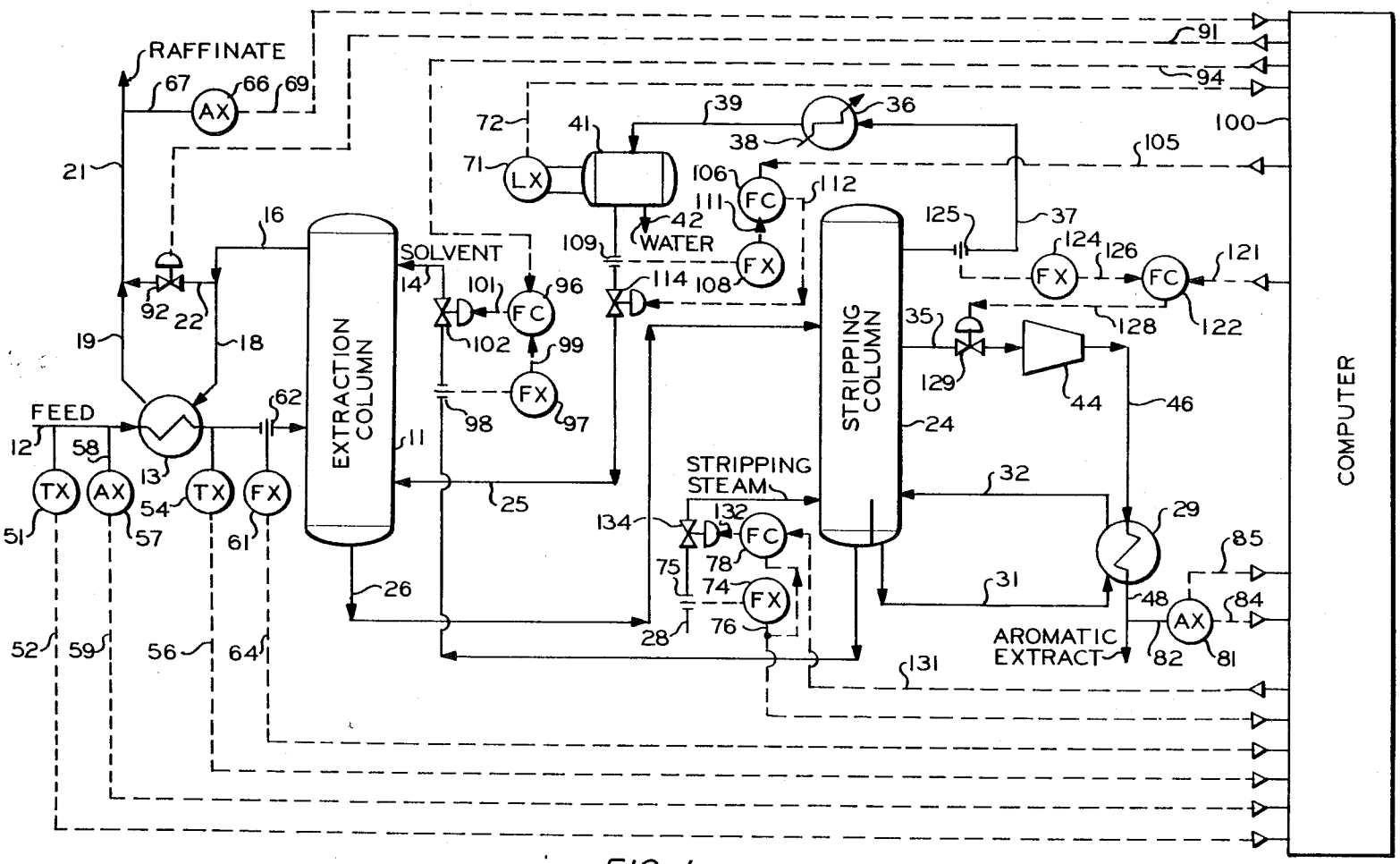
FIG. 1 is a diagrammatic illustration of an aromatic extraction process with the associated control system of the present invention.

A specific control system configuration is set forth in FIG. 1 for the sake of illustration. However, the invention extends to different types of control system configurations which accomplish the purpose of the invention. Lines designated as signal lines in the drawings are electrical or pneumatic in this preferred embodiment. Generally, the signals provided from any transducer are electrical in form. However, the signals provided from flow sensors will generally be pneumatic in form. Transducing of these signals is not illustrated for the sake of simplicity because it is well known in the art that, if a flow is measured in pneumatic form, it must be transduced to electrical form if it is to be transmitted in electrical form by a flow transducer. Also, transducing of the signals from analog form to digital form or from digital form to analog form is not illustrated because such transducing is also well known in the art.

The invention is also applicable to mechanical, hydraulic or other signal means for transmitting information. In almost all control systems some combination of electrical, pneumatic, mechanical or hydraulic signals will be used. However, use of any other type of signal transmission, compatible with the process and equipment in use, is within the scope of the invention.

A digital computer is used in the preferred embodiment of this invention to calculate the required control signals based on measured process parameters as well as set points supplied to the computer. Analog computers or other types of computing devices could also be used in the invention. The digital computer is preferably an OPTROL 7000 Process Computer System from Applied Automation, Inc., Bartlesville, Okla.

Signal lines are also utilized to represent the results of calculations carried out in a digital computer and the term "signal" is utilized to refer to such results. Thus, the term signal is used not only to refer to electrical currents or pneumatic pressures but is also used to refer to binary representations of a calculated or measured value.

The controllers shown may utilize the various modes of control such as proportional, proportional-integral, proportional-derivative, or proportional-integral-derivative. In this preferred embodiment, proportional-integral-derivative controllers are utilized but any controller capable of accepting two input signals and producing a scaled output signal, representative of a comparison of the two input signals, is within the scope of the invention.

The scaling of an output signal by a controller is well known in control system art. Essentially, the output of a controller may be scaled to represent any desired factor or variable. An example of this is where a desired flow rate and an actual flow rate is compared by a controller. The output could be a signal representative of a desired change in the flow rate of some gas necessary to make the desired and actual flows equal. On the other hand, the same output signal could be scaled to represent a percentage or could be scaled to represent a temperature change required to make the desired and actual flows equal. If the controller output can range from 0 to 10 volts, which is typical, then the output signal could be scaled so that an output signal having a voltage level of 5.0 volts corresponds to 50 percent, some specified flow rate, or some specified temperature.

The various transducing means used to measure parameters which characterize the process and the various signals generated thereby may take a variety of forms or formats. For example, the control elements of the system can be implemented using electrical analog, digital electronic, pneumatic, hydraulic, mechanical or other similar types of equipment or combinations of one or more such equipment types. While the presently preferred embodiment of the invention preferably utilizes a combination of pneumatic final control elements in conjunction with electrical analog signal handling and translation apparatus, the apparatus and method of the invention can be implemented using a variety of specific equipment available to and understood by those skilled in the process control art. Likewise, the format of the various signals can be modified substantially in order to accommodate signal format requirements of the particular installation, safety factors, the physical characteristics of the measuring or control instruments and other similar factors. For example, a raw flow measurement signal produced by a differential pressure orifice flow meter would ordinarily exhibit a generally proportional relationship to the square of the actual flow rate. Other measuring instruments might produce a signal which is proportional to the measured parameter, and still other transducing means may produce a signal which bears a more complicated, but known, relationship to the measured parameter. Regardless of the signal format or the exact relationship of the signal to the parameter which it represents, each signal representative of a measured process parameter or representative of a desired process value will bear a relationship to the measured parameter or desired value which permits designation of a specific measured or desired value by a specific signal value. A signal which is representative of a process measurement or desired process value is therefore one from which the information regarding the measured or desired value can be readily retrieved regardless of the exact mathematical relationship between the signal units and the measured or desired process units.

Referring now to FIG. 1, there is illustrated an extraction column 11 which is utilized to at least partially separate aromatic hydrocarbons from non-aromatic hydrocarbons. A feed stream containing the components to be separated is provided through conduit 12 to the extraction column 11. The feed will contain aromatic and non-aromatic hydrocarbons. The principle aromatic hydrocarbons are generally benzene and toluene.

A solvent is provided to the extraction column 11 through conduit 14. A solvent which may be used is tetraethylene glycol. The separation of the aromatic hydrocarbons from the non-aromatic hydrocarbons is based on a liquid-liquid extraction system in which the tetraethylene glycol selectively removes aromatic hydrocarbons.

A raffinate stream is withdrawn from an upper portion of the extraction column 11 through conduit 16. A portion of the raffinate stream withdrawn through conduit 16 is provided to the heat exchanger 13 through conduit 18 and is then withdrawn through conduits 19 and 21. A second portion of the raffinate stream flowing through conduit 16 is bypassed around the heat exchanger 13 through conduit 22. The raffinate stream flowing through conduit 18 is passed in heat exchange with the feed flowing through conduit 12 in the heat exchanger 13 and is utilized to provide heat to the feed flowing through conduit 12.

In addition to non-aromatic hydrocarbons, the raffinate stream will also contain some aromatic hydrocarbons since it is not possible to economically remove all aromatic hydrocarbons. However, the concentration of aromatic hydrocarbons is minimized to the extent economically possible as will be described more fully hereinafter.

A recycle stream from the upper portion of the stripping column 24 is provided to a lower portion of the extraction column 11 through conduit 25. Aromatic hydrocarbons, a small amount of non-aromatic hydrocarbons and solvent are removed from the bottom of the extraction column 11 through conduit 26 and are provided to an upper portion of the stripping column 24. This stream is generally referred to as the rich solvent stream while the solvent stream flowing through conduit 14 is generally referred to as the lean solvent stream.

Steam and heat are utilized to separate the solvent from the aromatic and non-aromatic hydrocarbons. Stripping steam is provided to a lower portion of the stripping column 24 through conduit 28. A portion of the liquid in the bottom of the stripping column is passed through heat exchanger 29 and recycled to the stripping column 24 through the combination of conduits 31 and 32.

The aromatic extract product stream is withdrawn from the stripping column 24 through conduit 35. An overhead stream is withdrawn from the stripping column 24 and is provided to the heat exchanger 36 through conduit 37.

The heat exchanger 36 is also provided with a cooling fluid which flows through conduit 38. The overhead stream flowing through conduit 37 is cooled in the heat exchanger 36 and the condensed overhead stream is provided through conduit 39 to the accumulator 41. Water (condensed steam) is removed from the accumulator 41 through conduit 42. The remaining portion of the liquid in the accumulator 41 is recycled to the extraction column 11 through conduit 25 as has been previously described.

The aromatic extract product stream withdrawn through conduit 35 is provided to the compressor 44. The aromatic extract product stream is compressed and then provided to the heat exchanger 29 through conduit 46. The aromatic extract product stream is withdrawn from the heat exchanger 29 through conduit 48.

Only those portions of the extraction process required to illustrate the present invention have been illustrated and described in FIG. 1. Other process streams would be withdrawn or provided to the extraction column and stripping column. However, such additional streams are well known and have not been illustrated for the sake of simplicity because such additional streams play no part in the description of the present invention.

Also, additional equipment such as pumps, additional heat exchangers, additional control components, etc. would typically be associated with an aromatic extraction process. Again, such additional equipment has not been illustrated since these additional components play no part in the description of the present invention.

In general, the control of the aromatic extraction process according to the present invention is accomplished by using process measurements to establish five control signals. The process measurements will first be described and then the use of the control signals will be described. Thereafter, the manner in which the process measurements are utilized to generate the control signals will be described.

Temperature transducer 51 in combination with a temperature sensing device such as a thermocouple, which is operably located in conduit 12 upstream of the heat exchanger 13, provides an output signal 52 which is representative of the actual temperature of the feed flowing to the heat exchanger 13. Signal 52 is provided from the temperature transducer 51 as an input to computer 100.

In like manner, temperature transducer 54 establishes an output signal 56 which is representative of the actual temperature of the feed flowing to the extraction column 11. Signal 56 is provided from the temperature transducer 54 as an input to computer 100.

Analyzer transducer 57 is a chromatographic analyzer. A chromatographic analyzer which may be used is the Model 102 Process Chromatograph manufactured by Applied Automation Inc. Analyzer transducer 57 is in fluid communication with conduit 12 through conduit 58. Based on an analysis of a sample of the feed flowing through conduit 12, analyzer transducer 57 provides an output signal 59 which is representative of the concentration of aromatics in the feed flowing through conduit 12. It is noted that, since benzene and toluene are the principle aromatics, signal 59 is preferably representative only of the concentration of benzene and toluene since this concentration may be obtained more quickly than a full range analysis of all aromatics. However, a full range analysis of all aromatics could be utilized if desired. Signal 59 is provided from the analyzer transducer 57 as an input to computer 100.

Flow transducer 61 in combination with the flow sensor 62, which is operably located in conduit 12, provides an output signal 64 which is representative of the flow rate of the feed to the extraction column 11. Signal 64 is provided from the flow transducer 61 as an input to computer 100.

As was the case with analyzer transducer 57, analyzer transducer 66 is also a chromatographic analyzer which may be a Model 102 process chromatograph. Analyzer transducer 66 is in fluid communication with conduit 21 through conduit 67. Analyzer transducer 66 provides an output signal 69 which is preferably representative of the concentration of toluene in the raffinate stream. Again, a concentration of all aromatics or a different aromatic could be obtained but it has been found that using the concentration of toluene only provides sufficient control of the concentration of aromatics in the raffinate stream and avoids the need for a full range analysis. Signal 69 is provided from the analyzer transducer 66 as an input to computer 100.

Level transducer 71 is operably connected to the accumulator 41. Level transducer 71 provides an output signal 72 which is representative of the actual liquid level in the accumulator 41. Signal 72 is provided from the level transducer 71 as an input to computer 100.

Flow transducer 74 in combination with the flow sensor 75, which is operably located in conduit 28, provides an output signal 76 which is representative of the actual flow rate of the stripping steam through conduit 28. Signal 76 is provided from the flow transducer 74 as the process variable input to the flow controller 78 and is also provided as an input to computer 100.

Analyzer transducer 81 is also chromatographic analyzer which may be a Model 102 Process Chromatograph. Analyzer transducer 81 is in fluid communication with conduit 48 through conduit 82. Analyzer transducer 81 provides two output signals 84 and 85. Signal 84 is representative of the concentration of $C_6$ and $C_7$ non-aromatics in the aromatic extract flowing through conduit 48. Signal 85 is representative of the concentration of $C_8+$ non-aromatics in the aromatic extract flowing through conduit 48. Both signals 84 and 85 are provided from the analyzer transducer 81 as inputs to computer 100. Different analyses could be used if desired but the above are preferred.

In response to the described process variable inputs and set point signals which will be described hereinafter, computer 100 calculates five control signals. A description of these control signals and the manner in which they are utilized to control the aromatic extraction process follows:

Signal 91 is representative of the position of the control valve 92, which is operably located in conduit 22, required to maintain the actual temperature of the feed flowing to the extraction column 11 substantially equal to a desired temperature. Signal 91 is provided from computer 100 as a control signal for the control valve 92 and the control valve 92 is manipulated in response thereto.

Signal 94 is representative of the flow rate of solvent through conduit 14 required to maintain a desired concentration of toluene in the raffinate flowing through conduit 21. Signal 94 is provided from computer 100 as the set point input to flow controller 96.

Flow transducer 97 in combination with the flow sensor 98, which is operably located in conduit 14, provides an output signal 99 which is representative of the actual flow rate of solvent through conduit 14. Signal 99 is provided as the process variable input to the flow controller 96.

In response to signals 94 and 99, the flow controller 96 provides an output signal 101 which is responsive to the difference between signals 94 and 99. Signal 101 is scaled so as to be representative of the position of the control valve 102, which is operably located in conduit 14, required to maintain the actual flow rate of solvent through conduit 14 substantially equal to the desired flow rate represented by signal 94. Signal 101 is provided from the flow controller 96 as a control signal for control valve 102 and control valve 102 is manipulated in response thereto.

Signal 105 is representative of the flow rate of the recycle stream through conduit 25 required to maintain a desired liquid level in the accumulator 41. Signal 105 is provided from computer 100 as the set point input to the flow controller 106.

Flow transducer 108 in combination with the flow sensor 109, which is operably located in conduit 25, provides an output signal 111 which is representative of the actual flow rate of the recycle stream flowing through conduit 25. Signal 111 is provided from the flow transducer 108 as the process variable input to the flow controller 106.

In response to signals 105 and 111, the flow controller 106 provides an output signal 112 which is responsive to the difference between signals 105 and 111. Signal 112 is scaled so as to be representative of the position of the control valve 114, which is operably located in conduit 25, required to maintain the actual flow rate of the recycle stream through conduit 25 substantially equal to the desired flow rate represented by signal 105. Signal 112 is provided from the flow controller 106 as a control signal for control valve 114 and control valve 114 is manipulated in response thereto.

Signal 121 is representative of the flow rate of the recycle stream flowing through conduit 37 required to maintain a desired concentration of $C_6$ and $C_7$ non-aromatics in the aromatic extract product stream. Signal 121 is provided as the set point input to the flow controller 122.

Flow transducer 124 in combination with the flow sensor 125, which is operably located in conduit 37, provides an output signal 126 which is representative of the actual flow rate of the recycle stream through conduit 37. Signal 126 is provided from the flow transducer 124 as the process variable input to the flow controller 122.

In response to signals 126 and 121, the flow controller 122 provides an output signal 128 which is responsive to the difference between signals 121 and 126. Signal 128 is scaled so as to be representative of the position of the control valve 129, which is operably located in conduit 35, required to maintain the actual flow rate of the recycle stream through conduit 37 substantially equal to the desired flow rate represented by signal 121. It is noted that the flow rate of the aromatic extract through conduit 35 directly controls the flow rate of the recycle stream through conduit 37. Signal 128 is provided from the flow controller 122 as a control signal for the control valve 129 and control valve 129 is manipulated in response thereto.

Signal 131 is representative of the flow rate of the stripping steam through conduit 28 required to maintain a desired concentration of $C_8+$ non-aromatics in the aromatic extract product stream. Signal 131 is provided as the process variable input to the flow controller 78.

In response to signals 76 and 131, the flow controller 78 provides an output signal 132 which is responsive to the difference between signals 76 and 131. Signal 132 is scaled so as to be representative of the position of the control valve 134, which is operably located in conduit 28, required to maintain the actual flow rate of the stripping steam through conduit 28 substantially equal to the desired flow rate represented by signal 131. Signal 132 is provided from the flow controller 78 as a control signal for control valve 134 and control valve 134 is manipulated in response thereto.

Figure 2:
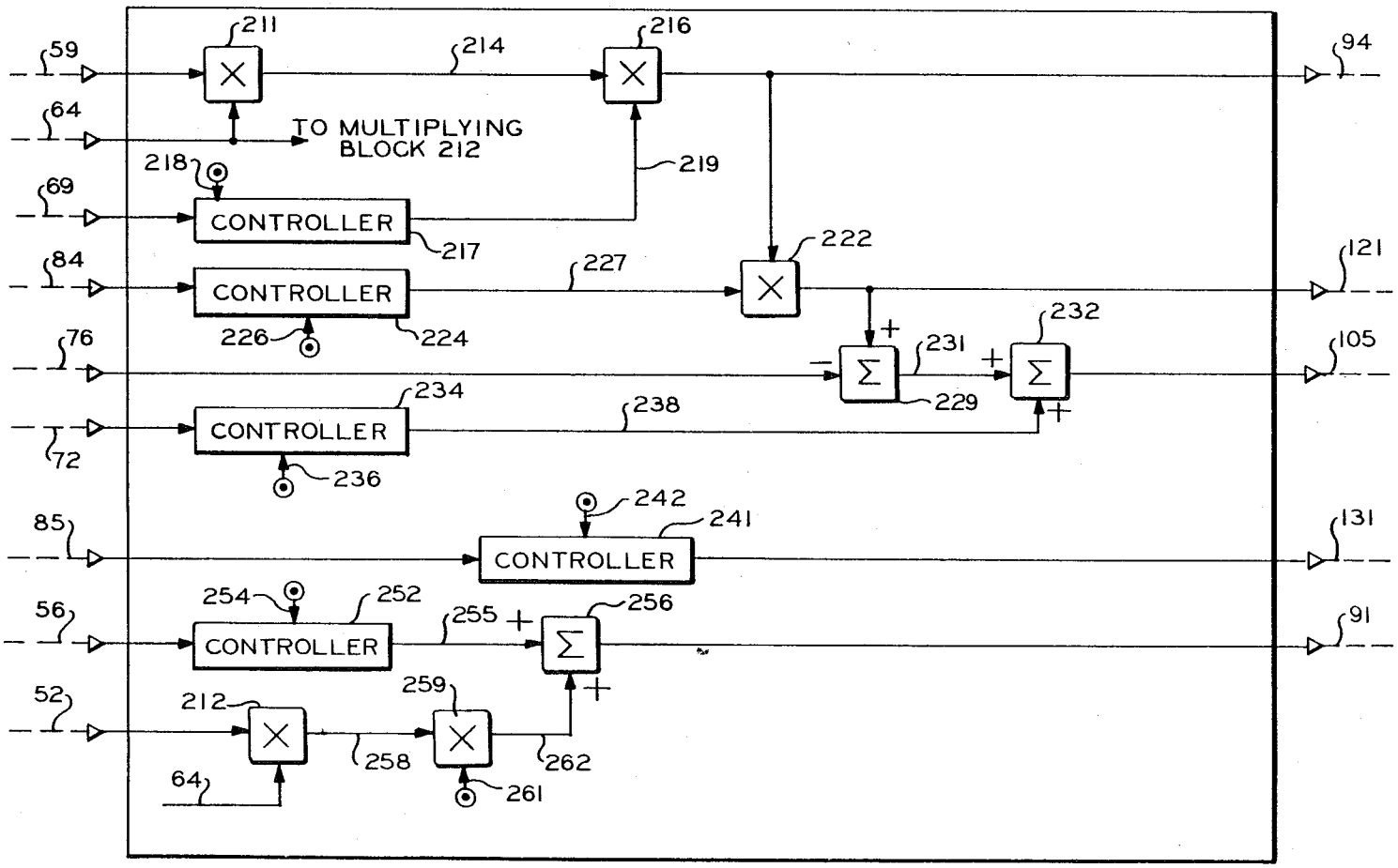
FIG. 2 is a flow diagram of the computer logic utilized to establish the control signals illustrated in FIG. 1 based on the process measurements illustrated in FIG. 1.

Referring now to FIG. 2 and the manner in which the process measurements are utilized to generate the described control signals, signal 59, which is representative of the concentration of toluene and benzene in the feed flowing to the extraction column 11 through conduit 12, is provided as a first input to the multiplying block 211. Signal 64, which is representative of the flow rate of the feed flowing to the extraction column 11, is provided as a second input to the multiplying block 211 and is also provided as the first input to the multiplying block 212.

Signal 59 is multiplied by signal 64 to establish signal 214 which is representative of the actual flow rate of benzene and toluene, which is considered to be representative of the actual flow rate of aromatics, to the extraction column 11. Signal 214 is provided from the multiplying block 211 as a first input to the multiplying block 216.

Signal 69, which is representative of the concentration of toluene in the raffinate and is considered to be essentially representative of the concentration of aromatics in the raffinate, is provided as the process variable input to the controller 217. The controller 217 is also provided with a set point signal 218 which is representative of the desired concentration of toluene in the raffinate. A typical range of values for signal 218 is 0–15 vol %.

In response to signals 69 and 218, the controller 217 provides an output signal 219 which is responsive to the difference between signals 69 and 218. Signal 219 is scaled so as to be representative of the ratio of the flow rate of solvent through conduit 14 to the flow rate of aromatics (benzene and toluene) through conduit 12 required to maintain a desired concentration of toluene in the raffinate. Signal 219 is provided from the flow controller 217 as a second input to the multiplying block 216.

Signal 214 is multiplied by signal 219 to establish signal 94 which is representative of the flow rate of solvent through conduit 14 required to maintain a desired concentration of toluene in the raffinate. Signal 94 is provided as a first input to the multiplying block 222. Signal 94 is also provided as an output control signal from computer 100 and is utilized as previously described.

Signal 84, which is representative of the concentration of $C_6$ and $C_7$ non-aromatic hydrocarbons in the aromatic extract product, is provided as the process variable input to the controller 224. The controller 224 is also provided with a set point signal 226 which is representative of the desired concentration of $C_6$ and $C_7$ non-aromatics in the aromatic extract product. A typical range of values for signal 226 is 0–1200 ppm (volume).

In response to signals 84 and 226, the controller 224 establishes an output signal 227 which is responsive to the difference between signals 84 and 226. Signal 227 is scaled so as to be representative of the ratio of the flow rate of the recycle stream through conduit 37 to the flow rate of the aromatics (toluene and benzene) to the extraction column through conduit 12 required to maintain the actual concentration of the $C_6$ and $C_7$ non-aromatics in the aromatic extract product substantially equal to the desired concentration represented by signal 226. Signal 227 is provided as a second input to the multiplying block 222.

Signal 94 is multiplied by signal 227 to establish signal 121 which is representative of the flow rate of the recycle stream through conduit 37 required to maintain the actual concentration of the $C_6$ and $C_7$ non-aromatics in the aromatic extract product substantially equal to the desired concentration represented by signal 226. Signal 121 is provided to the minuend input of the summing block 229. Signal 121 is also provided as an output control signal from computer 100 and is utilized as previously described.

Signal 76, which is representative of the actual flow rate of steam through conduit 28, is provided to the subtrahend input of the summing block 229. Signal 76 is subtracted from signal 121 to establish signal 231 which is provided as a first input to the summing block 232.

Signal 72, which is representative of the actual liquid level in the accumulator 41, is provided as the process variable input to the controller 234. The controller 234 is also provided with a set point signal 236 which is representative of the desired liquid level in the accumulator 41. The magnitude of signal 72 will typically be determined by the characteristics of the accumulator 41.

In response to signals 72 and 236, the controller 234 provides an output signal 238 which is responsive to the difference between signals 72 and 236. Signal 238 is scaled so as to be representative of a bias signal. Signal 238 is provided from the controller 234 as a second input to the summing block 232.

Under ideal circumstances, signal 231 could be utilized directly to control the liquid level in the accumulator 41. Water is removed from the accumulator 41 and this removal is compensated for by subtracting the steam flow rate. Thus, a removal of the recycled stream through conduit 25 equal to the flow rate represented by signal 231 would ideally maintain a desired liquid level in the accumulator 41. However, it has been found that signal 231 will not always provide a desired liquid level and thus a bias term is provided by the output signal 238 from the controller 234. Essentially, the bias term may be considered a feedback control function which is based on actual liquid level with signal 231 being considered a feed forward control signal based on a predicted liquid level.

Signals 231 and 238 are summed to establish signal 105. Signal 105 is provided as an output control signal from computer 100 and is utilized as previously described.

Signal 85, which is representative of the actual concentration of $C_8+$ non-aromatics in the aromatic extract product, is provided as the process variable input to the controller 241. The controller 241 is also provided with a set point signal 242 which is representative of the desired concentration of $C_8+$ non-aromatics in the aromatic extract product. A typical range of values for signal 242 is 0–1200 ppm (volume).

In response to signals 85 and 242, the controller 241 establishes an output signal 131 which is responsive to the difference between signals 85 and 242. Signal 131 is scaled so as to be representative of the flow rate of steam through conduit 28 required to maintain the actual concentration of $C_8+$ non-aromatics in the aromatic extract product substantially equal to the desired concentration represented by signal 242. Signal 131 is provided as a control signal output from computer 100 and is utilized as previously described.

Signal 56, which is representative of the actual temperature of the feed provided to the extraction column through conduit 12, is provided as the process variable input to the controller 252. The controller 252 is also provided with a set point signal 254 which is representative of the desired temperature of the feed flowing to the extraction column 11. A typical value for signal 254 is about 216° F.

In response to signals 56 and 254, the controller 252 provides an output signal 255 which is responsive to the difference between signals 56 and 254. Signal 255 is scaled so as to be representative of the position of control valve 92 (percentage open) required to maintain the actual temperature of the feed provided to the extraction column 11 substantially equal to the desired temperature represented by signal 254. Signal 255 is provided as a first input to the summing block 256.

Signal 52, which is representative of the actual temperature of the feed upstream of the heat exchanger 13, is provided as a second input to the multiplying block 212. Signal 52 is multiplied by signal 64 to establish signal 258. Signal 258 is provided as a first input to the multiplying block 259.

Signal 261 is provided as a second input to the multiplying block 258. Signal 261 is essentially the slope of a plot of flow multiplied by temperature (signal 258) as a function of percent valve open (valve 92). Signal 261 has units such that the output signal 262 from the multiplying block 259 is in terms of valve position (percent valve open). Signal 262 is a feed forward bias term which is utilized to bias signal 255.

Signals 255 and 262 are summed to establish signal 91 which is provided as an output control signal from computer 100 and is utilized as previously described.

In summary, the control of both the $C_6$ and $C_7$ impurities in the aromatic extract and the control of the aromatics in the raffinate based on the aromatic flow rate to the extraction column is a particularly beneficial feature of the present invention. Such control provides a feed forward or a predictive element which is particularly beneficial in maintaining product purity during times of process upsets.

The additional control described is interactive with the primary control of aromatic extract and raffinate quality. As an example, close control of the temperature of the feed flowing to the extraction column enables closer control of product qualities to be maintained. Also, control of the stripping steam directly affects the quality of the aromatic extract.

The invention has been described in terms of a preferred embodiment as illustrated in FIGS. 1 and 2. Specific components which can be used in the practice of the invention as illustrated in FIG. 1 such as flow transducer 61, 74, 97, 108 and 124; flow sensor 62, 75, 98, 109 and 125; temperature transducers 51 and 54; flow controllers 96, 78, 106 and 122; level transducer 71; and control valves 92, 102, 114, 129 and 134 are each well known commercially available control components such as are described at length in Perry's Chemical Engineer's Handbook, 4th Edition, Chapter 22, McGraw-Hill.

While the invention has been described in terms of the presently preferred embodiment, reasonable variations and modifications are possible by those skilled in the art. An example of such a modification is the use of analyses of different components as previously discussed. Such modifications and variations are within the scope of the described invention and the appended claims.

That which is claimed is:

1. Apparatus comprising:

an extraction column;

means for providing a feed stream containing aromatic and non-aromatic hydrocarbons to said extraction column;

means for providing a solvent stream having a selectivity for aromatic hydrocarbons to said extraction column, wherein said solvent stream passes in contact with said feed stream in said extraction column to remove a substantial portion of said aromatic hydrocarbons from said feed stream;

means for withdrawing a raffinate stream from an upper portion of said extraction column, wherein said raffinate stream contains most of the non-aromatic hydrocarbons contained in said feed stream;

a stripping column;

means for withdrawing a rich solvent stream from a lower portion of said extraction column and for providing said rich solvent stream as a feed to said stripping column, wherein said rich solvent stream contains most of the aromatic hydrocarbons contained in said feed stream;

means for withdrawing a recycle stream from an upper portion of said stripping column and for providing said recycle stream to said extraction column;

means for withdrawing an aromatic extract product stream from said stripping column;

means for supplying stripping steam to a lower portion of said stripping column, wherein said stripping steam passes in contact with said rich solvent stream in said stripping column to separate said aromatic hydrocarbons from said solvent and wherein said solvent stream provided to said extraction column is withdrawn from a lower portion of said stripping column;

means for establishing a first signal representative of the flow rate of at least a portion of the aromatic hydrocarbons contained in said feed stream to said extraction column;

means for establishing a second signal representative of the concentration of at least a first non-aromatic component of said aromatic extract product stream;

means for establishing a third signal representative of the desired concentration of at least said first non-aromatic component of said aromatic extract product stream;

means for comparing said second signal and said third signal and for establishing a fourth signal which is responsive to the difference between said second signal and said third signal, wherein said fourth signal is scaled so as to be representative of the ratio of the flow rate of said recycle stream from said stripping column to the flow rate represented by said first signal required to maintain the actual concentration of at least said first non-aromatic component in said aromatic extract product stream substantially equal to the desired concentration represented by said third signal;

means for multiplying said first signal by said fourth signal to establish a fifth signal which is representative of the flow rate of said recycle stream from said stripping column required to maintain the concentration of at least said first non-aromatic component in said aromatic extract product stream substantially equal to the desired concentration represented by said third signal; and means for manipulating the flow rate of said recycle stream in response to said fifth signal.

2. Apparatus in accordance with claim 1 wherein said means for establishing said first signal comprises:

means for establishing a sixth signal representative of the actual flow rate of said feed stream to said extraction column;

means for establishing a seventh signal representative of the actual concentration of toluene and benzene in said feed stream; and means for multiplying said sixth signal by said seventh signal to establish said first signal.

3. Apparatus in accordance with claim 2 wherein said second signal is representative of the concentration of $C_6$ and $C_7$ non-aromatics in said aromatic extract product stream and wherein said means for manipulating the flow rate of said recycle stream in response to said fifth signal comprises:

a control valve operably located so as to manipulate the flow rate of said aromatic extract product stream, wherein the flow rate of said aromatic extract product stream directly determines the flow rate of said recycle stream;

means for establishing a sixth signal representative of the actual flow rate of said recycle stream;

means for comparing said fifth signal and said sixth signal and for establishing a seventh signal which is responsive to the difference between said fifth signal and said sixth signal, wherein said seventh signal is scaled so as to be representative of the position of said control valve required to maintain the actual flow rate of said recycle stream substantially equal to the desired flow rate represented by said fifth signal; and means for manipulating said control valve in response to said seventh signal.

4. Apparatus in accordance with claim 1 additionally comprising:

means for establishing a sixth signal representative of the actual concentration of at least a first aromatic component in said raffinate stream;

means for establishing a seventh signal representative of the desired concentration of at least said first aromatic component in said raffinate stream;

means for comparing said sixth signal and said seventh signal and for establishing an eighth signal which is responsive to the difference between said sixth signal and said seventh signal, wherein said eighth signal is scaled so as to be representative of the ratio of the flow rate of said solvent to said extraction column to the flow rate represented by said first signal required to maintain the actual concentration of at least said first aromatic component in said raffinate stream substantially equal to the desired concentration represented by said seventh signal;

means for multiplying said first signal and said eighth signal to establish a ninth signal representative of the flow rate of said solvent stream to said extraction column required to maintain the actual concentration of at least said first aromatic component in said raffinate stream substantially equal to the desired concentration represented by said seventh signal; and means for manipulating the flow rate of said solvent stream to said extraction column in response to said ninth signal.

5. Apparatus in accordance with claim 4 wherein said sixth signal is representative of the concentration of toluene in said raffinate stream and wherein said means for manipulating the flow rate of said solvent stream to said extraction column in response to said ninth signal comprises:

a control valve operably located so as to manipulate the flow rate of said solvent stream to said extraction column;

means for establishing a tenth signal representative of the actual flow rate of said solvent stream to said extraction column;

means for comparing said ninth signal and said tenth signal and for establishing an eleventh signal which is responsive to the difference between said ninth signal and said tenth signal, wherein said eleventh signal is scaled so as to be representative of the position of said control valve required to maintain the actual flow rate of said solvent stream to said extraction column substantially equal to the desired flow rate represented by said ninth signal; and means for manipulating said control valve in response to said eleventh signal.

6. Apparatus in accordance with claim 1 additionally comprising:

means for establishing a sixth signal representative of the concentration of at least a second non-aromatic component of said aromatic extract product stream;

means for establishing a seventh signal representative of the desired concentration of at least said second non-aromatic component of said aromatic extract product stream;

means for comparing said sixth signal and said seventh signal and for establishing an eighth signal which is responsive to the difference between said sixth signal and seventh signal, wherein said eighth signal is scaled so as to be representative of the flow rate of said stripping steam to said stripping column required to maintain the actual concentration of at least said second non-aromatic component of said aromatic extract product stream substantially equal to the desired concentration represented by said seventh signal; and means for manipulating the flow rate of said stripping steam in response to said eighth signal.

7. Apparatus in accordance with claim 6 wherein said sixth signal is representative of the concentration of $C_8+$ non-aromatics in said aromatic extract product stream and wherein said means for manipulating the flow rate of said stripping steam in response to said eighth signal comprises:

a control valve operably located so as to manipulate the flow rate of said stripping steam;

means for establishing a ninth signal representative of the actual flow rate of said stripping steam;

means for comparing said eighth signal and said ninth signal and for establishing a tenth signal which is responsive to the difference between said eighth signal and said ninth signal, wherein said tenth signal is scaled so as to be representative of the position of said control valve required to maintain the actual flow rate of said stripping steam substantially equal to the desired flow rate represented by said eighth signal; and means for manipulating said control valve in response to said tenth signal.

8. Apparatus in accordance with claim 1 wherein said means for providing said recycle stream to said extraction column comprises:

a heat exchanger;

an accumulator;

means for passing said recycle stream withdrawn from said stripping column through said heat exchanger to said accumulator;

means for providing a cooling fluid to said heat exchanger;

means for withdrawing water from said accumulator;

means for withdrawing liquid hydrocarbons from said accumulator and for providing said liquid hydrocarbons as said recycle stream to said extraction column, wherein the control of the flow rate of said recycle stream in response to said fifth signal is a control of the flow rate of said recycle stream before said recycle stream passes through said accumulator and wherein said apparatus additionally comprises:

means for establishing a sixth signal representative of the actual liquid level in said accumulator;

means for establishing a seventh signal representative of the desired liquid level in said accumulator;

means for comparing said sixth signal and said seventh signal and for establishing an eighth signal which is responsive to the difference between said sixth signal and said seventh signal, wherein said eighth signal is scaled so as to be a bias signal;

means for establishing a ninth signal representative of the actual flow rate of said stripping steam;

means for subtracting said ninth signal from said fifth signal to establish a tenth signal;

means for summing said tenth signal and said eighth signal to establish an eleventh signal wherein said eleventh signal is representative of the flow rate of said recycle stream withdrawn from said accumulator required to maintain the actual liquid level in said accumulator substantially equal to the desired liquid level represented by said seventh signal; and means for manipulating the flow rate of said recycle stream withdrawn from said accumulator in response to said eleventh signal.

9. Apparatus in accordance with claim 8 wherein said means for manipulating the flow rate of said recycle stream withdrawn from said accumulator in response to said eleventh signal comprises:

a control valve operably located so as to manipulate the flow rate of said recycle stream withdrawn from said accumulator;

means for establishing a twelfth signal representative of the actual flow rate of said recycle stream withdrawn from said accumulator;

means for comparing said eleventh signal and said twelfth signal and for establishing a thirteenth signal which is responsive to the difference between said eleventh signal and said twelfth signal, wherein said thirteenth signal is scaled so as to be representative of the position of said control valve required to maintain the actual flow rate of said recycle stream withdrawn from said accumulator substantially equal to the desired flow rate represented by said eleventh signal; and means for manipulating said control valve in response to said thirteenth signal.

10. Apparatus in accordance with claim 1 wherein said means for withdrawing said raffinate stream from said extraction column comprises:

a heat exchanger;

means for passing a first portion of said raffinate stream withdrawn from said extraction column in heat exchange with said feed stream in said heat exchanger;

means for bypassing a second portion of said raffinate stream around said heat exchanger;

a control valve operably located so as to manipulate the flow of said second portion of said raffinate stream;

means for establishing a sixth signal representative of the actual temperature of said feed flowing to said extraction column;

means for establishing a seventh signal representative of the desired temperature of said feed flowing to said extraction column;

means for comparing said sixth signal and said seventh signal and for establishing an eighth signal which is responsive to the difference between said sixth signal and said seventh signal, wherein said eighth signal is scaled so as to be representative of the position of said control valve required to maintain the actual temperature of said feed flowing to said extraction column substantially equal to the desired temperature represented by said seventh signal;

means for establishing a ninth signal representative of the actual flow rate of said feed stream;

means for establishing a tenth signal representative of the actual temperature of said feed stream before said feed stream is passed in heat exchange with said raffinate stream;

means for multiplying said ninth signal and said tenth signal to establish an eleventh signal;

means for establishing a twelfth signal representative of the slope of a plot of said eleventh signal as a function of the position of said control valve;

means for multiplying said eleventh signal and said twelfth signal to establish a thirteenth signal which is a bias signal;

means for summing said eighth signal and said thirteenth signal to establish a fourteenth signal; and means for manipulating the position of said control valve in response to said fourteenth signal.

11. A method for controlling an aromatic extraction process in which a feed stream containing aromatic and non-aromatic hydrocarbons is passed in contact with a solvent stream having a selectivity for aromatic hydrocarbons in an extraction column to remove a substantial portion of said aromatic hydrocarbons from said feed stream, wherein a raffinate stream containing most of the non-aromatic hydrocarbons contained in said feed stream is withdrawn from an upper portion of said extraction column, wherein a rich solvent stream containing most of the aromatic hydrocarbons contained in said feed stream is withdrawn from a lower portion of said extraction column and provided as a feed to a stripping column, wherein a recycle stream is withdrawn from an upper portion of said stripping column and provided to said extraction column, wherein an aromatic extract product stream is withdrawn from said stripping column, wherein stripping steam is passed in contact with said rich solvent stream in said stripping column to at least partially separate said aromatic hydrocarbons from said solvent and wherein said solvent stream passed in contact with said feed stream in said extraction column is withdrawn from a lower portion of said stripping column, said method comprising the steps of:

establishing a first signal representative of the flow rate of at least a portion of the aromatic hydrocarbons contained in said feed stream to said extraction column;

establishing a second signal representative of the concentration of at least a first non-aromatic component of said aromatic extract product stream;

establishing a third signal representative of the desired concentration of at least said first non-aromatic component of said aromatic extract product stream;

comparing said second signal and said third signal and establishing a fourth signal which is responsive to the difference between said second signal and said third signal, wherein said fourth signal is scaled so as to be representative of the ratio of the flow rate of said recycle stream from said stripping column to the flow rate represented by said first signal required to maintain the actual concentration of at least said first non-aromatic component in said aromatic extract product stream substantially equal to the desired concentration represented by said third signal;

multiplying said first signal by said fourth signal to establish a fifth signal which is representative of the flow rate of said recycle stream from said stripping column required to maintain the concentration of at least said first non-aromatic component in said aromatic extract product stream substantially equal to the desired concentration represented by said third signal; and manipulating the flow rate of said recycle stream in response to said fifth signal.

12. A method in accordance with claim 11 wherein said step of establishing said first signal comprises:

establishing a sixth signal representative of the actual flow rate of said feed stream to said extraction column;

establishing a seventh signal representative of the actual concentration of toluene and benzene in said feed stream; and multiplying said sixth signal by said seventh signal to establish said first signal.

13. A method in accordance with claim 12 wherein said second signal is representative of the concentration of $C_6$ and $C_7$ non-aromatics in said aromatic extract product stream and wherein said step of manipulating the flow rate of said recycle stream in response to said fifth signal comprises:

establishing a sixth signal representative of the actual flow rate of said recycle stream;

comparing said fifth signal and said sixth signal and establishing a seventh signal which is responsive to the difference between said fifth signal and said sixth signal, wherein said seventh signal is scaled so as to be representative of the position of a control valve, operably located so as to manipulate the flow rate of said aromatic extract product stream, required to maintain the actual flow rate of said recycle stream substantially equal to the desired flow rate represented by said fifth signal; and means for manipulating said control valve in response to said seventh signal, wherein the flow rate of said aromatic extract product stream directly determines the flow rate of said recycle stream.

14. A method in accordance with claim 11 additionally comprising the steps of:

establishing a sixth signal representative of the actual concentration of at least a first aromatic component in said raffinate stream;

establishing a seventh signal representative of the desired concentration of at least said first aromatic component in said raffinate stream;

comparing said sixth signal and said seventh signal and establishing an eighth signal which is responsive to the difference between said sixth signal and said seventh signal, wherein said eighth signal is scaled so as to be representative of the ratio of the flow rate of said solvent to said extraction column to the flow rate represented by said first signal required to maintain the actual concentration of at least said first aromatic component in said raffinate stream substantially equal to the desired concentration represented by said seventh signal;

multiplying said first signal and said eighth signal to establish a ninth signal representative of the flow rate of said solvent stream to said extraction column required to maintain the actual concentration of at least said first aromatic component in said raffinate stream substantially equal to the desired concentration represented by said seventh signal; and manipulating the flow rate of said solvent stream to said extraction column in response to said ninth signal.

15. A method in accordance with claim 14 wherein said sixth signal is representative of the concentration of toluene in said raffinate stream and wherein said step of manipulating the flow rate of said solvent stream to said extraction column in response to said ninth signal comprises:

establishing a tenth signal representative of the actual flow rate of said solvent stream to said extraction column;

comparing said ninth signal and said tenth signal and establishing an eleventh signal which is responsive to the difference between said ninth signal and said tenth signal, wherein said eleventh signal is scaled so as to be representative of the position of a control valve, operably located so as to manipulate the flow rate of said solvent stream, required to maintain the actual flow rate of said solvent stream to said extraction column substantially equal to the desired flow rate represented by said ninth signal; and manipulating said control valve in response to said eleventh signal.

16. A method in accordance with claim 11 additionally comprising the steps of:

establishing a sixth signal representative of the concentration of at least a second non-aromatic component of said aromatic extract product stream;

establishing a seventh signal representative of the desired concentration of at least said second non-aromatic component of said aromatic extract product stream;

comparing said sixth signal and said seventh signal and establishing an eighth signal which is responsive to the difference between said sixth signal and seventh signal, wherein said eighth signal is scaled so as to be representative of the flow rate of said stripping steam to said stripping column required to maintain the actual concentration of at least said second non-aromatic component of said aromatic extract product stream substantially equal to the desired concentration represented by said seventh signal; and manipulating the flow rate of said stripping steam in response to said eighth signal.

17. A method in accordance with claim 16 wherein said sixth signal is representative of the concentration of $C_8+$ non-aromatics in said aromatic extract product stream and wherein said step of manipulating the flow rate of said stripping steam in response to said eighth signal comprises:

establishing a ninth signal representative of the actual flow rate of said stripping steam;

comparing said eighth signal and said ninth signal and establishing a tenth signal which is responsive to the difference between said eighth signal and said ninth signal, wherein said tenth signal is scaled so as to be representative of the position of a control valve, operably located so as to manipulate the flow rate of said stripping steam, required to maintain the actual flow rate of said stripping steam substantially equal to the desired flow rate represented by said eighth signal; and manipulating said control valve in response to said tenth signal.

18. A method in accordance with claim 11 wherein said recycle stream is provided to said extraction column by cooling said recycle stream in a heat exchanger, passing the cooled recycle stream to an accumulator, removing water from said recycle stream in said accumulator and providing liquid hydrocarbons from said accumulator as said recycle stream to said extraction column, wherein the control of the flow rate of said recycle stream in response to said fifth signal is a control of the flow rate of said recycle stream before said recycle stream passes through said accumulator and wherein said method additionally comprises the steps of:

establishing a sixth signal representative of the actual liquid level in said accumulator;

establishing a seventh signal representative of the desired liquid level in said accumulator;

comparing said sixth signal and said seventh signal and establishing an eighth signal which is responsive to the difference between said sixth signal and said seventh signal, wherein said eighth signal is scaled so as to be a bias signal;

establishing a ninth signal representative of the actual flow rate of said stripping steam;

subtracting said ninth signal from said fifth signal to establish a tenth signal;

summing said tenth signal and said eighth signal to establish an eleventh signal wherein said eleventh signal is representative of the flow rate of said recycle stream withdrawn from said accumulator required to maintain the actual liquid level in said accumulator substantially equal to the desired liquid level represented by said seventh signal; and manipulating the flow rate of said recycle stream withdrawn from said accumulator in response to said eleventh signal.

19. A method in accordance with claim 18 wherein said step of manipulating the flow rate of said recycle stream withdrawn from said accumulator in response to said eleventh signal comprises:

establishing a twelfth signal representative of the actual flow rate of said recycle stream withdrawn from said accumulator;

comparing said eleventh signal and said twelfth signal and for establishing a thirteenth signal which is responsive to the difference between said eleventh signal and said twelfth signal, wherein said thirteenth signal is scaled so as to be representative of the position of a control valve, operably located so as to manipulate the flow rate of said recycle stream withdrawn from said accumulator, required to maintain the actual flow rate of said recycle stream withdrawn from said accumulator substantially equal to the desired flow rate represented by said eleventh signal; and manipulating said control valve in response to said thirteenth signal.

20. A method in accordance with claim 1 wherein said raffinate stream is withdrawn from said extraction column by passing a first portion of said raffinate stream in heat exchange with said feed stream in a heat exchanger and bypassing a second portion of said raffinate stream around said heat exchanger and wherein said method additionally comprises the steps of:

establishing a sixth signal representative of the actual temperature of said feed flowing to said extraction column;

establishing a seventh signal representative of the desired temperature of said feed flowing to said extraction column;

comparing said sixth signal and said seventh signal and establishing an eighth signal which is responsive to the difference between said sixth signal and said seventh signal, wherein said eighth signal is scaled so as to be representative of the position of a control valve, operably located so as to manipulate the flow of said second portion of said raffinate stream, required to maintain the actual temperature of said feed flowing to said extraction column substantially equal to the desired temperature represented by said seventh signal;

establishing a ninth signal representative of the actual flow rate of said feed stream;

establishing a tenth signal representative of the actual temperature of said feed stream before said feed stream is passed in heat exchange with said raffinate stream;

multiplying said ninth signal and said tenth signal to establish an eleventh signal;

establishing a twelfth signal representative of the slope of a plot of said eleventh signal as a function of the position of said control valve;

multiplying said eleventh signal and said twelfth signal to establish a thirteenth signal which is a bias signal;

summing said eighth signal and said thirteenth signal to establish a fourteenth signal; and manipulating the position of said control valve in response to said fourteenth signal.

* * * * *